US006321941B1

(12) United States Patent
Argentieri et al.

(10) Patent No.: US 6,321,941 B1
(45) Date of Patent: Nov. 27, 2001

(54) CONSUMER SAFE FITMENT FOR CONNECTING A RESERVOIR TO A DISPENSING APPLIANCE

(75) Inventors: Andrea Argentieri, Ixelles (BE); Yvon Loic Crozet, Rome (IT); John Russell Lawson, Cincinnati, OH (US); Patrizio Ricci, Wemmel (BE); Jelle Dankert Vuijk, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/553,226

(22) Filed: Apr. 20, 2000

(51) Int. Cl.[7] ..... B67D 5/00
(52) U.S. Cl. ..... 222/81
(58) Field of Search ..... 222/81, 105, 501, 222/531, 533, 559; 141/19, 329, 330, 383, 384

(56) References Cited

U.S. PATENT DOCUMENTS

| | | | | |
|---|---|---|---|---|
| D. 424,167 | | 5/2000 | Yuen . | |
| 2,882,940 | * | 4/1959 | Zellweger | 222/81 |
| 3,092,106 | | 6/1963 | Butler . | |
| 3,131,712 | | 5/1964 | Risley . | |
| 3,200,994 | | 8/1965 | Levinson . | |
| 3,542,240 | | 11/1970 | Solowey . | |
| 3,685,694 | | 8/1972 | Ianelli . | |
| 3,828,973 | | 8/1974 | Birrel . | |
| 3,952,918 | | 4/1976 | Poitras . | |
| 3,953,902 | | 5/1976 | Taylor . | |
| 3,995,772 | | 12/1976 | Liautaud . | |
| 4,173,295 | | 11/1979 | Steinmann . | |
| 4,699,188 | | 10/1987 | Baker . | |
| 5,020,220 | | 6/1991 | Miyake . | |
| 5,086,950 | | 2/1992 | Crossdale . | |
| 5,104,003 | | 4/1992 | Stecoza . | |
| 5,370,164 | * | 12/1994 | Galloway | 141/329 |
| 5,425,528 | | 6/1995 | Rains . | |
| 5,435,462 | | 7/1995 | Fujii . | |
| 5,732,853 | | 3/1998 | Ganzeboom . | |
| 5,827,486 | | 10/1998 | Crossdale . | |

(List continued on next page.)

FOREIGN PATENT DOCUMENTS

| | | |
|---|---|---|
| 2007887 | 7/1990 | (CA) . |
| 2008148 | 7/1990 | (CA) . |
| 2075473 | 8/1991 | (CA) . |
| 2091020 | 10/1993 | (CA) . |
| 2157597 | 9/1994 | (CA) . |
| 2133238 | 4/1995 | (CA) . |
| 0 369 722 B1 | 5/1990 | (EP) . |
| 2 264 702 | 9/1993 | (GB) . |
| 2 339 772 | 2/2000 | (GB) . |
| WO 83/00932 | 3/1983 | (WO) . |

*Primary Examiner*—Philippe Derakshani
*Assistant Examiner*—Thach H. Bui
(74) *Attorney, Agent, or Firm*—Thibault Fayette; Jeffrey V. Bamber

(57) ABSTRACT

The present invention is directed to a device for the delivery of products, preferably cleaning products comprising an active ingredient, more preferably cleaning products comprising a surfactant, the device comprising at least one vented reservoir for containing at least one liquid product and a means for dispensing the product from the reservoir, the device being characterized in that the reservoir comprises at least one recess and/or protrusion and the dispensing means comprises at least one corresponding protrusion and/or recess, said reservoir being releasably secured in a leak-tight manner with the dispensing means such that fluid communication between said reservoir and said means is established, only when said protrusion(s) and recess(es) are fitted into each other, and said protrusion(s) and said recess (es) of said reservoir have a shape which is complementary, preferably exactly complementary, to said protrusion(s) and/or recess(es) of said dispensing means.

11 Claims, 4 Drawing Sheets

U.S. PATENT DOCUMENTS

| | | | | |
|---|---|---|---|---|
| 5,842,682 | * | 12/1998 | Schennum et al. | 222/105 |
| 5,875,921 | | 3/1999 | Osgar . | |
| 5,893,397 | * | 4/1999 | Peterson et al. | 141/329 |
| 5,896,898 | | 4/1999 | Crossdale . | |
| 6,095,370 | | 8/2000 | Rhine . | |
| 6,109,480 | | 8/2000 | Monsrud . | |
| 6,152,327 | | 11/2000 | Rhine . | |

* cited by examiner

CONSUMER SAFE FITMENT FOR CONNECTING A RESERVOIR TO A DISPENSING APPLIANCE

FIELD OF THE INVENTION

The present invention relates to a device comprising a reservoir and a dispensing means, with improved fitment system between said reservoir and said means.

BACKGROUND OF THE INVENTION

Spray devices are known for the purposes of domestic cleaning, for example for cleaning hard surfaces such as windows, baths and ovens, as well as for spot cleaning of floor coverings such as carpets. Most spray devices which are commercially available are manually or electrically operated, that is to say that the devices comprise a pump which is activated or operated by the consumer. Most commonly this activation generates liquid pressure in a chamber by means of a positive displacement pump which in turn drives the liquid from the chamber usually through a dispensing nozzle. Many dispensing patterns are possible, but a conical spray is the most common. Usually, such spray devices comprise a reservoir filled with an active composition, and a means to dispense the composition from within said reservoir. The spray devices typically further comprise a basic fitment system to secure the reservoir onto the dispensing means, so as to establish a fluid communication between the two.

D1 (U.S. Pat. No. 5,389,085 ) is a U.S. patent to International Medical Consultants, Inc. It discloses an automatic needle protector, especially for use with a syringe. The needle protector comprises a cylinder slidably mounted via a spring onto the syringe. In normal position, the spring pushes the cylinder, which surrounds the needle. When a vertical pressure is applied onto the cylinder, and the cylinder slides down, giving access to the needle.

D2 (U.S. Pat. No. 5,486,163 ) is a U.S. patent to Haynes Miller, Inc. It discloses a shield for protecting the needle of a syringe, with an annular connector for connecting the two, and comprising at least one protective arm hingedly mounted upon the connector and pivotable between a first protecting position, and a second open position.

While solving some issues, the above mentioned inventions still present some disadvantages. After removing the reservoir from the appliance, the needle is accessible by anyone who would put his hand into the appliance's recess. Such needles are typically very sharp, and likely to cause injury upon contact, more particularly if some dispensed product remains on it. This is true for any type of user, but especially true for children. Indeed, it has been shown that children are very curious and while playing, they tend to put their hands into the recess of the dispensing appliance.

It is therefore one main object of the present invention to provide the user with a liquid dispensing appliance comprising a vented reservoir filled with a liquid, and a dispensing appliance, said reservoir and said appliance being fitted such as to prevent any leakage during the use of the appliance, and where the fitment between said appliance and said reservoir is such that it prevents access to the fitment's needle when said reservoir is removed from said appliance.

SUMMARY OF THE INVENTION

The present invention is directed to fitment for establishing a leak-tight fluid communication between a dispensing appliance and a reservoir to connect to said appliance, said fitment comprising at least one pierceable means and at least one needle for piercing said at least one pierceable means, wherein said fitment comprises a protecting means to prevent access to said at least one needle unless said reservoir is connected to said appliance.

The present invention is further directed to a dispensing appliance and a reservoir which are removably connectable by means of a fitment as defined above.

BRIEF DESCRIPTION OF THE DRAWINGS

The invention will now be explained in detail with reference to the accompanying drawings, in which.

DETAILED DESCRIPTION OF THE INVENTION

In the present invention a device (1) is provided for dispensing a product onto a surface, preferably a cleaning product, more preferably a cleaning product for treating carpets or other large fabric coverings. Said device (1) comprises the combination of a reservoir (10) for containing a composition, preferably a liquid cleaning product, with an appliance for dispensing the product. Any type of device comprising a dispensing appliance and a reservoir can use a fitment as hereafter described, in order to establish a fluid communication between said reservoir and said dispensing appliance. However, in the rest of the present description, and for clarity purposes, one embodiment of a dispensing appliance (11) is described in more detail, which preferably comprises a housing, a spraying arm (12), and a means for conducting product from the reservoir (10) to the spraying arm.

Figure 4:
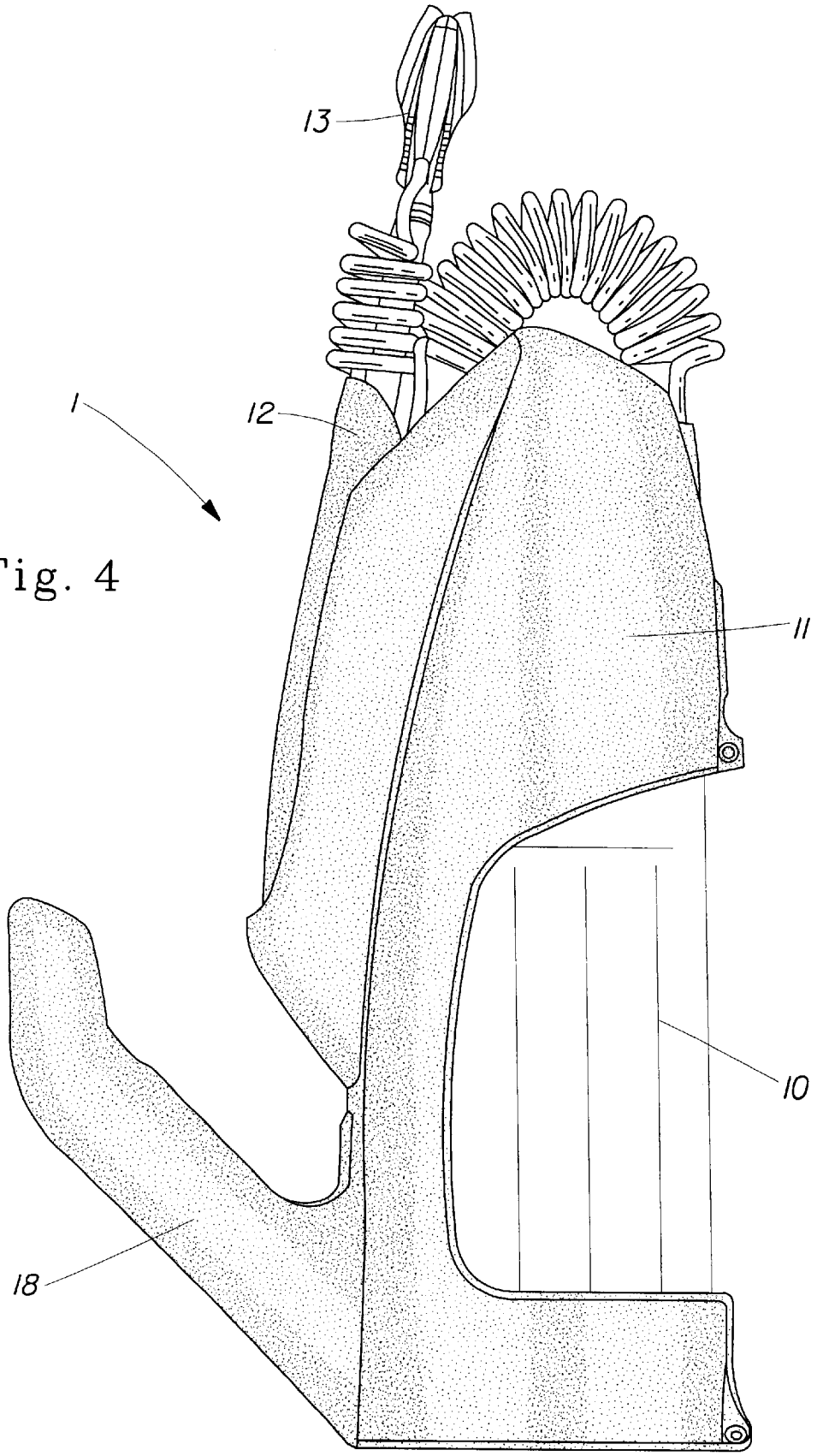
FIG. 4 is a profile view of an appliance with reservoir fitted therein.
Figure 5:
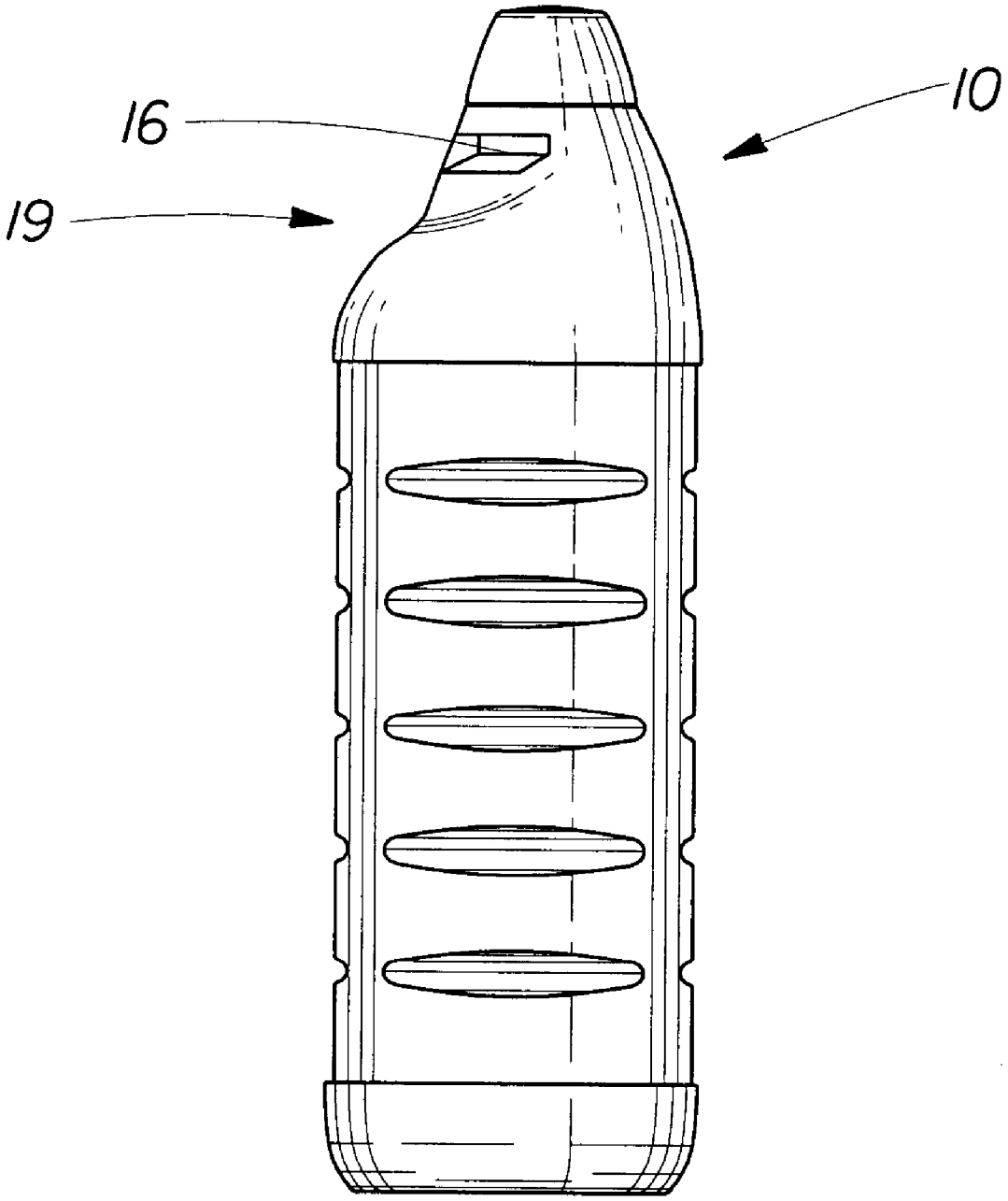
FIG. 5 is a side view of one non-limiting example of a reservoir.

Preferably, the dispensing appliance (11) comprises a manually or electrically driven pump. More preferably, said dispensing appliance (11) comprises an electrically driven pump which is used to pump product from the reservoir (10) through the spraying arm and out of the product dispensing opening (or openings) located in the spraying arm, to the surface to be treated. In this way, the dispensing appliance (11) connected to a reservoir (10) constitutes an electrical spraying device (1), as shown for example in FIG. 4. The product dispensing openings are preferably nozzles which are selected so that the sprayed product takes the form of a continuous stream or film, or of a discontinuous stream or film of fine particles, or of a mist, or of a foam. It is most preferred that the spray pattern is in the form of fine particles because this is the most efficient way to cover a large surface area with a small volume of product with an even coverage. Typically the product output is from about 20 ml/minute to about 400 ml/minute, and preferably from about 150 ml/minute to about 250 ml/minute, the product being typically suitable for carpet cleaning. Devices which can use a fitment according to the present invention are for example devices for spraying household cleaning or laundry products, or perfumes. In a preferred embodiment, such devices are used for dispensing a cleaning solution for cleaning surfaces such as fabrics, carpets, floors, and ceilings.

It is preferred that the spray arm (12) has one nozzle (13), but it may also have multiple nozzles located along its length. The spray arm (12) makes it easier to control where the cleaning product is sprayed. For example, when cleaning carpets the spray arm (12) makes it easier to avoid spraying product onto furniture and walls, and also enables access into corners which would otherwise be difficult to reach. Furthermore, an ergonomically designed spray arm (12) avoids the need for the user to have a bent back when spraying. The spray arm (12) is preferably extendible and/or detachable from the dispensing means housing.

The dispensing appliance

In one preferred embodiment of the present invention, the fitment as described hereafter is to be used in a dispensing appliance (11) which comprises a means for conducting the product from the reservoir (10) through the spray arm (12), to the product dispensing opening from which said product is dispensed. Said means for conducting the product is connected to the reservoir (10) and to the spray arm (12), for example via pipes, which can be for example flexible plastic pipes, and more importantly, through a fitment system which is hereafter described in more detail. The means for conducting the product from the reservoir (10) to the spray arm (12) is preferably contained into the housing, as well as the pipes, if any.

For any type of device (1) that is to be used with a fitment according to the present invention, it is essential that said dispensing appliance (11) comprises a piercing means, or a pierceable means that fits respectively a corresponding pierceable means or piercing means of the reservoir (10). Preferably, said dispensing appliance comprises a piercing means which fits into a corresponding pierceable means of the reservoir. More preferably, said piercing means of the dispensing appliance is achieved by at least one needle (15), which fits with a pierceable means of the reservoir (10), as shown in FIGS. 1 to 4. Also more preferably, the pierceable means of the reservoir is integrated to a cap that closes said reservoir. Even more preferably, said pierceable means is an elastomeric membrane (or septum) and the appliance comprises two needles, one being connected to the pumping means, the other one comprising a one-way valve or venting membrane for letting air enter the reservoir (10) while the contents is removed therefrom, thus playing the role of a venting system.

Alternatively, said piercing means is located onto the reservoir, and said pierceable means is located into the appliance. In the rest of the present description, only the preferred embodiment featuring the needle(s) onto the appliance and the pierceable means onto the reservoir will be further discussed, but this should not be taken as a restriction to the scope of the present invention.

Figure 1A:
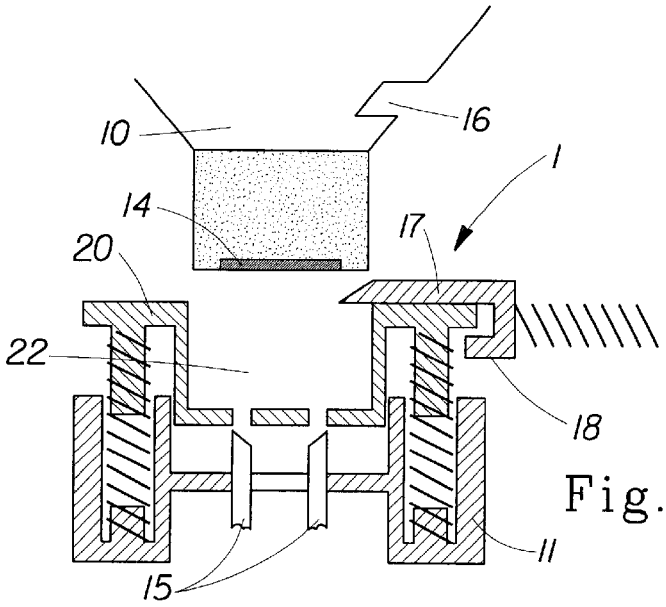
FIGS. 1A to 1C are schematic profile cut views showing one embodiment of the fitment means, with the reservoir respectively disconnected, partially connected and fully connected to the appliance.
Figure 1B:
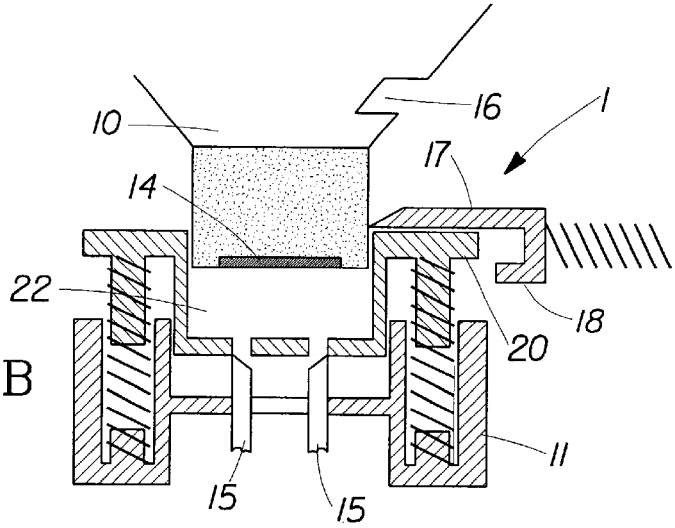
Figure 1C:
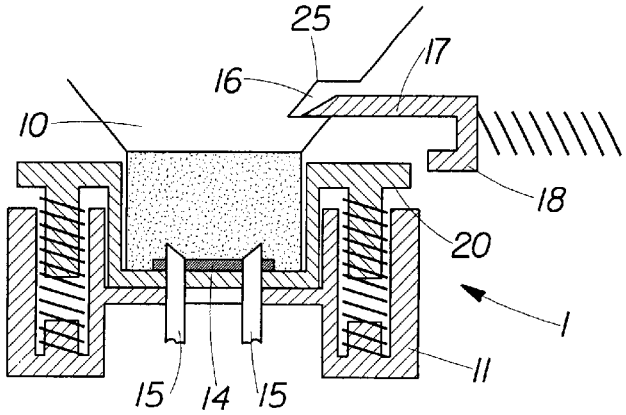

At first use, when the consumer inserts the reservoir (10) into the dispensing appliance (11), the elastomeric membrane (14) is pierced, as shown in FIG. 1C, so as to establish a leak-tight fluid communication between the interior of said reservoir (10) and the dispensing appliance (11). Then, the reservoir's contents is pumped through one needle (15), to the pump, up to the spray arm's nozzles, and is dispensed to the surface to treat. This provides a device wherein the operation of plugging/unplugging the reservoir from the housing of the dispensing means in order to establish a fluid, but leak-tight, communication between the two is very easy and obvious to the consumer. It also provides a fitment which is not very complex (needle and elastomeric membrane) and thus quite cheap to produce.

In a particularly preferred embodiment of the present invention, the means for conducting the product from the reservoir (10) through the spray arm (12) to the product dispensing opening comprises an electrically driven pump. The electrically driven pump may be, for example, a gear pump, an impeller pump, a piston pump, a screw pump, a peristaltic pump, a diaphragm pump, or any other miniature pump. In one embodiment the pump is a gear pump with a typical speed between 6000 and 12000 rpm.

The electrically driven pump must be driven by a means such as an electric motor. The electric motor typically produces a torque between 1 and 50 mN.m. The electric motor must, in turn be provided with a power source. The power source may be either mains electricity (optionally via transformer), or it may be a throw-away battery, or rechargeable battery. Most preferred are one or more AA rechargeable or disposable batteries, the batteries being housed in the package. The voltage output of the battery is typically between 1.5 and 12 Volts, with a preferred output between 3 and 6V .

In one embodiment of this invention, the pump is designed to be reversible, so that it can dispense liquid from the reservoir (10), and suck liquid from a surface, or only from the pipes of the dispensing appliance (11), back into the same or preferably another reservoir (10). Typically, only small amounts of liquid can be sucked back from a surface, and such a reversible pump is not intended to replace the use of a vacuum cleaner. Several ways of inverting the rotation of the pump can be used. In one example, the pump and motor are linked to a timer and an electronic circuit, such that after a defined time (eg. 15 seconds) the motor is not used, it automatically starts again, and its rotation side is reversed. As a result, the remaining product in the tubing and the extension of the dispensing appliance (11) is sucked back into the reservoir (10). As a consequence when replacing a product by another one, it is easy to change the product without mixing new and old products. For example, the consumer can use the dispensing appliance (11) for dispensing a first type of composition, then wait for the pump to suck back said first composition from the pipes, and then change the reservoir (10) or its contents to dispense a second composition without mixing of the two compositions inside the pipes.

In a preferred embodiment of the present invention, the dispensing appliance (11) comprises at least one recess and/or protrusion (17) to fit onto at least one corresponding protrusion and/or recess (16) of the reservoir, said reservoir (10) being releasably secured in a leak-tight manner into the dispensing appliance (11) such that fluid communication between said reservoir (10) and said means is established, only when said protrusion(s) and recess(es) are fitted into each other, and said protrusion(s) and said recess(es) (16) of said reservoir (10) have complementary shapes of said protrusion(s) and/or recess(es) (17) of said dispensing appliance (11). Preferably, the dispensing means comprises at least one protrusion that fits into a corresponding and complementary recess of the reservoir, as shown in FIGS. 1 to 4. Also preferably, said protrusion(s) and said recess(es) (16) of said reservoir (10) have exactly complementary shapes of said protrusion(s) and/or recess(es) (17) of said dispensing appliance (11). Indeed, it is preferred that all the contours of the reservoir fit all the contours of the recess of the dispensing means, thus providing enhanced maintain of said reservoir. However, the shape of the reservoir may be such that it differs from the shape of the dispensing means' housing but still fits therein, such that a fluid connection between the two is established. However, it will be easily understood that the risk of leakage is enhanced in case all the contours of the reservoir are not properly maintained by the contours of the dispensing means.

The handling means

The device (1) according to the present invention is preferably hand-held, and therefore preferably comprises a holding means, which is more preferably integrated to the housing of the dispensing appliance (11). The holding means may be any sort of handle (18) which will allow the user to pick up the device (1) and to carry it to the place where the spraying is to be carried out. The handle (18) can be part of the reservoir (10) or of the housing of the dispensing appliance (11). It is likely that the device (1) will be carried around a whole room when a carpet is being cleaned, and/or will be manipulated in all directions during use. The handle (18) may be a simple protrusion or indentation which may be gripped by the user, or it may be a more sophisticated design for ergonomic reasons.

In one alternative embodiment of the present invention, the housing of the dispensing appliance (11) comprises a means allowing the user to carry it without using hands. In a first example, the housing comprises a clip which allows the user to hang said housing to a belt. In another example, the housing comprises at least one shoulder strap which allows to carry said housing on the shoulder/back. Other such means may be applied which allow the user to use both hands for other tasks.

The reservoir

The device (1) comprises at least one reservoir (10) which can be of any type capable of containing a product under liquid form —by liquid it is meant to include embodiments when the product comprises a solid and a solvent for progressively dissolving said solid. Also included are liquids comprising small particles in suspension. Said reservoir (10) is preferably located into the housing of the dispensing appliance (11), and can be made out of any suitable material, such as metal, alloy, glass, but is preferably made out of plastic. It comprises at least one compartment comprising at least one composition. Also preferably, the reservoir is vented. This means that the reservoir (10) comprises a means for connection to the dispensing appliance (11), such that it provides fluid connection between the two and allows fluid to exit said reservoir into said dispensing appliance (11), but it also allows simultaneous admission of air back into the reservoir (10) to compensate the loss of contents. Such a vented reservoir is clearly necessary, especially in case the reservoir is rigid and its contents is pumped by an electrical pump in a continuous manner and/or is used over a long period without stopping the dispensing of contained product. Indeed, while the contents is being removed from the reservoir, the same volume of gas or air needs to be replaced, otherwise, a depression is created which stops the pump after a while. Some alternative solutions could be envisaged, such as for example a reservoir made of two portions, one rigid outer shell combined with a flexible collapsible inner pouch, or a flexible pouch, with at least one rigid portion, for example the spout. In such a system, the inner pouch would progressively collapse during dispensing of the product, thus avoiding the need for replacement of the dispensed contents by a gas, and thus avoiding the need for a venting system. However, it has been found that such alternative systems are technically difficult to manufacture, and are expensive.

In a preferred embodiment of the invention, the dispensing means comprises two needles: one is for dispensing of liquid from the reservoir, the other one is for admission of air back into said reservoir, so as to ensure that the loss of contents in said reservoir is compensated. Such a connection system ensures that the reservoir is correctly vented, thus ensuring proper continuous pumping and dispensing of its contents. But alternatively, the venting of the reservoir can be achieved by a one-way valve, or by a venting membrane.

The at least one reservoir (10) can be fixed into the housing of the dispensing appliance (11), and then, preferably comprises one opening, more preferably a reclosable opening. Alternatively, the at least one reservoir (10) can be removable from the housing of the dispensing appliance (11), so that it is replaceable when empty, or it can be refilled, for example with tap water.

In a first embodiment, the dispensing appliance (11) comprises one reservoir (10) with one compartment, comprising one or more composition(s), preferably one composition.

In a second embodiment, the dispensing appliance (11) comprises one reservoir (10) with at least two different compartments, each of which can comprise different compositions, for example non-miscible compositions or two chemically reacting solutions which react once mixed. Such a reservoir (10) is made for example by an extrusion blowing process.

In a third embodiment, the dispensing appliance (11) comprises at least two separate reservoirs. These reservoirs can have different shapes, for example they can be designed with complementary shapes. Alternatively, different reservoirs can be plugged into the dispensing appliance (11) at different locations. Said reservoirs can comprise one or more compartments comprising same, but most preferably different products.

In a forth embodiment, the dispensing appliance (11) comprises at least one portion for connecting a reservoir (10) comprising a liquid such as a solvent or water, and at least one additional portion for connecting a small cartridge of a concentrated composition, for example under liquid, gel or granulated form. At the time the consumer uses the dispensing appliance (11), the composition contained into the cartridge will be dissolved into the solvent or water, and the resultant active liquid composition will be dispensed through the spray nozzle (13). Alternatively, said cartridge is connected directly into one portion of a reservoir (10). The cartridge can be for example screwed into an appropriate opening of the housing, or of the reservoir (10). It comprises a seal portion, such that when fully screwed, it sealably closes said appropriate opening.

In all of the preceding embodiments, when the dispensing appliance (11) comprises more than one reservoir (10), the proportion of product pumped can differ from one reservoir (10) to another. For example, this is achieved by selecting pipes of different diameters for a reservoir (10) and another, or by adding a flow-control means to the pipes between one reservoir (10) and the pump.

In another embodiment, a kit is also provided which comprises the dispensing appliance (11) and at least one reservoir (10) comprising a product, said appliance and said reservoir being fitted by a fitment as per the present invention. Preferably, the kit comprises the dispensing appliance (11) and a set of several removable reservoirs, each comprising a different product. The different products can be products for treating different areas such as carpets, kitchen surfaces, bathroom surfaces, cars or else.

In a particularly preferred embodiment of the present invention, the neck (19) of the reservoir (10) is off-centered in the cross sectional plan of the said reservoir (10), relatively to the central axis of said reservoir (10), and the reservoir (10) is non-cylindrical. This is best shown in FIGS. 3A to 3F. Such a shape prevents the reservoir (10) from moving laterally and/or rotationally into the dispensing means housing, especially during use, thus preventing leakage.

In a preferred embodiment of the present invention, the reservoir (10) comprises at least one recess and/or protrusion (16) to fit into at least one corresponding protrusion and/or recess (17) of the device's dispensing appliance (11), said reservoir (10) being releasably secured in a leak-tight manner into the dispensing appliance (11) such that fluid communication between said reservoir (10) and said means is established, only when said protrusion(s) and recess(es) are fitted into each other, and said protrusion(s) and said recess (es) (16) of said reservoir (10) have complementary shapes of said protrusion(s) and/or recess(es) (17) of said dispensing appliance (11). Preferably, the reservoir (10) comprises at least one recess (16) that fits to a corresponding and complementary protrusion (17) of the dispensing appliance (11), as shown in FIGS. 1 to 4. Also preferably, said protrusion(s) and said recess(es) (16) of said reservoir (10) have exactly complementary shapes of said protrusion(s) and/or recess(es) (17) of said dispensing appliance (11), for the reasons explained above. The recess can be an integral part of the reservoir's walls, but alternatively, said recess is created when a cap is secured onto the neck of said reservoir, said cap having a greater external diameter than the external diameter of the reservoir's neck.

Reservoir/dispensing appliance locking mechanism

It has been shown that devices which comprise the assembling of a dispensing appliance and a reservoir, and which are subject to movements in all directions during use, are subject to leakage between said reservoir (10) and said dispensing appliance (11). This leads to spilling of product onto unexpected areas, which is clearly messy, and can even be dangerous, depending on the nature of the product which is dispensed.

Preferably, the reservoir (10) which is provided is non-cylindrical, and has a off-centered neck (19). This provides stability and prevents lateral and rotational movements of said reservoir (10) within the dispensing means's housing. Especially, the non-cylindrical shape of the reservoirs prevents rotational movements. However, there can still be some leakage due to axial movement of the reservoir (10) (i.e. along the longitudinal axis of the reservoir). In order to prevent such axial movements, the device (1) is further preferably provided with a releasable locking mechanism (25) between the reservoir (10) and the housing of the appliance. Thus, it is a highly preferred feature of the present invention that the reservoir (10) comprises at least one recess and/or protrusion and the dispensing appliance (11) comprises at least one corresponding protrusion and/or recess, said reservoir (10) being releasably secured in a leak-tight manner with the dispensing appliance (11) such that fluid communication between said reservoir (10) and said means is established, only when said protrusion(s) and recess(es) are fitted into each other, and said protrusion(s) and said recess(es) of said reservoir (10) have a shape which is complementary to said protrusion(s) and/or recess(es) of said dispensing appliance (11). Preferably, said protrusion(s) and said recess(es) (16) of said reservoir (10) have exactly complementary shapes of said protrusion(s) and/or recess (es) (17) of said dispensing appliance (11), for the reasons explained above.

In a first embodiment, and as shown in FIGS. 1A to 1C, the reservoir (10) comprises one recess (16) which is located in one of its lateral walls, i.e. in its body portion. The dispensing appliance (11) comprises one protrusion (17) which is positioned such that when the needle (15) of said dispensing appliance (11) has pierced the elastomeric membrane (14) of the reservoir's cap, and a fluid communication is established between the two, the protrusion (17) exactly fits into the recess (16). In this way, the reservoir (10) is tightly maintained into the housing of the appliance (11), thus preventing leakage of product at the interface between the needle (15) and the pierceable means (14).

In a second embodiment of the present invention, as shown in FIGS. 2A to 2D, the reservoir (10) comprises one recess which is located near the top, for example on the neck (19), or directly on the cap (28), or alternatively, the recess is constituted by the difference of external diameter between the neck (19) of the bottle and the cap (28) itself. In the latter case, if the external diameter of the cap (28) is greater than the external diameter of the reservoir's neck (19), a recess is created at the time the cap is secured onto said neck. The dispensing appliance (11) comprises one protrusion which is positioned such that when the needle (15) of said dispensing appliance (11) has pierced the rubber septum (14) of the reservoir's cap (28), and a fluid communication is established between the two, the protrusion exactly fits into the recess. This second embodiment might be preferred to the first one. Indeed, the reservoir is preferably manufactured with a blow-molding process. Thus, tolerances in the reservoir are not as precise as the tolerance of a piece which is injection molded. There is a need for high accuracy in the mating of the locking fitment system to prevent movement of the reservoir (10) within the dispensing means housing. This is highly critical in the region of the connection between the needle (15) and the elastomeric membrane (14), where the risk of leakage is the highest. It was found that by minimizing the distance between the locking mechanism (25) and the membrane/needle fitment, the reservoir (10) is better held in place into the housing, in the region of the membrane/needle fitment.

In any case, it is a preferred feature of the device (1) according to the present invention, that the at least one recess and/or protrusion of the reservoir (10) is located at less than 25 cm, preferably less than 20 cm, more preferably less than 10 cm from the top of said reservoir (10).

As shown in FIGS. 1A to 1C, it is highly preferred that the locking mechanism (25) between the reservoir (10) and the dispensing appliance (11) be releasable. To this effect, the at least one protrusion is movable, such that it can be engaged/disengaged from the corresponding recess(es). This is preferably achieved by providing a locking mechanism (25) which is of the push-button type, press-button type, or any other suitable means for releasing the at least one protrusion from the at least one recess. More preferably, the locking mechanism (25) is a push-button releasable locking mechanism (25). It comprises a movable protrusion (17) which is mounted with a spring means (27), for example an helicoidal metallic spring (27), or a plastic spring blade. The protrusion (17) is connected to a push button, which is accessible to the consumer from the outside of the device's housing. When the reservoir (10) is in place and locked into the housing, the user can exert a push on the button, to release the protrusion (17) from the reservoir's recess, and remove said reservoir (10) from the device (1).

The protrusion can have any shape, as long as it is an exact complementary shape of the recess. For example, in can be a simple pin, but it can also be a hook, or it can even have more complex shape, as door keys have.

As hereafter described in more detail, it is an essential feature of the present invention that the needles (15) which are mounted onto the appliance (11) are protected from access by a consumer, by a spring loaded protecting plate (20) which prevents access to said needles (15) when the appliance contains no reservoir (10), and which frees the access to the needles (15) whenever a reservoir (10) is fully inserted into said appliance (11).

In a highly preferred embodiment of the present invention, the spring-loaded movable protrusion (17) which releasably locks the reservoir (10) inside the dispensing appliance's recess is further provided with a means for locking the protecting plate (20) into the position wherein it prevents access to the needles (15), as shown in FIG. 1A. This provides a double security, since the protecting plate (20) cannot be moved without first pressing onto the movable protrusion. Practically, the coordinated movement of pressing onto said movable protrusion, and at the same time, moving the protecting plate (20) to access the needles (15), cannot be done accidentally since said movable protrusion, and said protecting plate (20) are not located at the same place. It is even more difficult for a child that would play with the appliance, even for a long time. Thus, this system of linking the locking mechanism (25) to the spring-loaded protecting plate (20) provides additional benefit to the device (1) as a child-resistant feature.

Figure 2A:
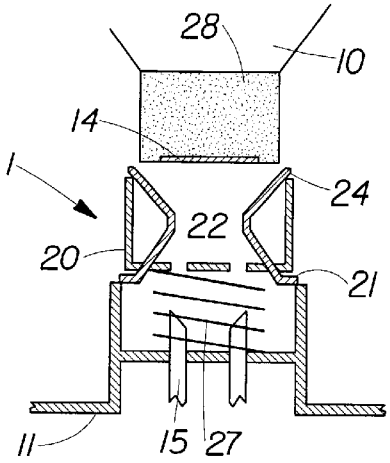
FIGS. 2A to 2D are schematic profile cut views showing another embodiment of the fitment means, with the reservoir respectively disconnected, partially connected and fully connected to the appliance.
Figure 2B:
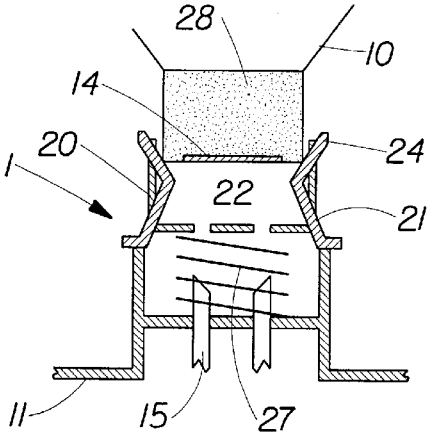
Figure 2C:
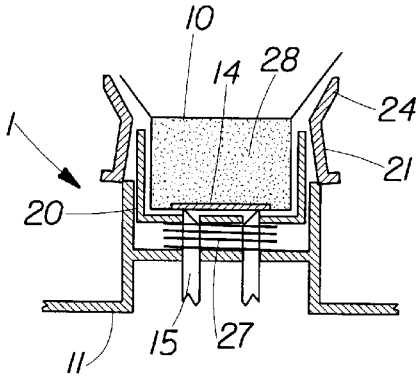
Figure 2D:
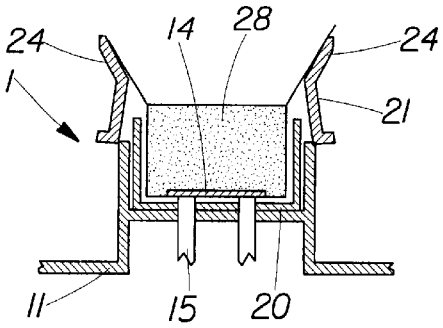
Figure 3:
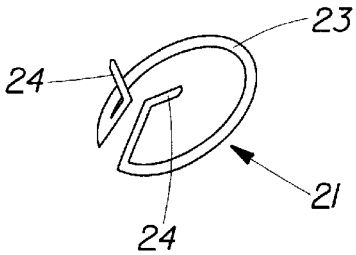
FIG. 3 is a perspective view of one embodiment of a spring for loading onto the protecting plate.

In a second embodiment of the present invention, the protecting plate (20) is secured in locked position while preventing access to the needles by a circlip (21), as shown in FIGS. 2A to 2D. As shown in FIG. 3, the circlip (21) is a flexible, substantially circular spring, preferably made out of metal, but which can be made out of any other suitable flexible material. Said circlip comprises a main ring (23) which is discontinued in its median portion, and two extensions (24) of this main ring (23) extending upwardly. Said circlip (21) is inserted between the fitment of the appliance (11) and the protecting plate (20). In normal position, the main ring (23) of the circlip has a diameter which is lower than the external diameter of the base of the protecting plate (20), such that said protecting plate cannot move down to the bottom of the appliance's fitment, and thus it is locked in "needle-protecting" position. Whenever the reservoir (10) is inserted into the appliance (11), said reservoir's shoulders push onto the extensions (24) of the circlip (21), with the effect that it increases the diameter of the main ring (23), as shown in FIGS. 2C and 2D, such that said diameter of the main ring (23) becomes greater than the external diameter of the protecting plate (20). Thus, said protecting plate (20) is free to slide down and to give access to the needles (15) that pierce the membrane (14) of the reservoir, as shown in FIG. 2D.

Reservoir/dispensing appliance fitment

As it has been previously described, the reservoir (10) is fitted to the dispensing appliance (11) by means of at least one piercing means (15)—for example at least one needle (15)—which punctures at least one pierceable means (14). Preferably, said at least one needle (15) is located into a recess of the appliance, into which said reservoir (10) is normally placed during use, and said pierceable means (14) is located onto the reservoir (10).

The at least one needle (15) which is used for the present invention may have several shapes or constitute materials such as stainless steel, tantalum, zirconium . . . etc., but preferably, it is made out of metal stainless steel 304 or similar stainless steel. More preferably it has an outside diameter comprised within the range of 0.7 to 7 mm, and more preferably an outside diameter comprised within the range of 0.7 to 2.5 mm. Also preferably, it has an internal diameter comprised within the range of 0.5 to 2 mm, and even more preferably, an inside diameter comprised within the range of 0.5 to 1.5 mm. In case said at least one needle is a bevel-edged needle, it preferably has a tip angle comprised within the range of 15° to 30°, and even more preferably, said needle (15) has a tip angle of 21°. However, other shapes for a needle can be used.

It has been found that bevel-edged needles may be at least partially obstructed by a portion of the membrane, which may render the appliance non-functional. This is due to the fact that the heel of the needle's bevel is very sharp, and at the time the needle is inserted into the membrane, said sharp heel may poke out a little portion of the membrane, which then slides into the needle's channel, leading to obstruction of said channel. One solution to avoid that problem is to use a non-coring needle, which is defined as a needle that is designed and manufactured such that it cannot poke out a portion of the material wherein said needle is inserted. There are different types of non-coring needles. For example, it can be achieved by sand-blasting the heel of the bevel, so as to erode it, until it loses its sharpness. Alternatively, the needle can be shaped like a pencil tip, with its hole located on a lateral side of the needle, and not on the tip itself, so that no beveled sharp edges can cut and detach a portion of the pierceable material. Alternatively, the needle's tip can be in the shape of a scalpel blade, with the hole located on a lateral side of the needle, not on the blade itself, so that no beveled sharp edge can be cut and detach a portion of the pierceable material. Such non-coring needles are known in the art, and the skilled person may appropriately chose the right shape and size for a needle, to meet the purpose of the present invention.

It has been found that after removing the reservoir (10) from the appliance, the needle (15) is accessible by anyone who would put his hand into the appliance's recess. Such needles (15) are typically very sharp, and likely to cause injury upon contact, more particularly if some dispensed product remains on it. This is true for any type of user, but especially true for children. Indeed, it has been shown that children are very curious and while playing, they tend to put their hands into the recess of the dispensing appliance (11).

Thus it is an essential feature of the fitment between the bottle and the appliance, according to the present invention, that it comprises a protecting means (20) to prevent access to said at least one needle (15), unless said reservoir (10) is connected to said appliance.

Preferably, as shown in FIGS. 1A to 1C, the protecting means (20) is a movable protecting plate (20). More preferably, said protecting plate (20) comprises a recess (22) in the shape of the cap. Said protecting plate (20) is spring loaded, so that it automatically returns to a position in which access to the needles (15) is prevented, whenever the reservoir (10) is removed from the appliance. Any type of spring can be used, but preferably, the springs (27) are helicoidal springs (27), as shown in FIGS. 1A to 1C. At the time the reservoir (10) is inserted into the appliance, the neck (19) of the reservoir (10) and/or closure push against said protecting plate (20) so that the needles (15) are accessible, and can pierce the pierceable means (14) to establish a fluid communication in a leak-tight manner between said reservoir (10) and said dispensing appliance (11).

Pierceable means

After removing the reservoir (10) from the appliance, the user might be in a situation where a certain amount of product remains in said reservoir (10), for example in case the user would like to temporarily use the dispensing appliance (11) for dispensing another type of product. In this case, the remaining product may well leak through the open pierceable means (14) of the reservoir (10), which is clearly undesirable to the consumer. Also, during usage of the device (1), it is essential that the fitment between the reservoir (10) and the dispensing appliance (11) is leak-tight, so as to prevent that liquid can contact the interior of the appliance. Indeed in some cases, said appliance is electrical, so any leakage of liquid inside the electrical circuits may lead to damage to the appliance, or even to injuries to the user, which is of course clearly undesirable.

In the following description, for clarity purposes, the sole embodiment wherein the pierceable means (14) of the reservoir (10) is a pierceable membrane (14) will be discussed. However, this should not limit the scope of the present invention, since the pierceable means (14) may alternatively be achieved in other ways. For example, the pierceable means (14) can be one portion of the reservoir's wall which is for example molded integrally with said reservoir (10) by a co-injection molding process, also it can be a portion which is added to the walls of the reservoir (10) by means of gluing or welding process.

After the reservoir (10) has been in place within the appliance for one month or more, it has been shown that most known membranes stay in a deformed configuration, more particularly, they keep the form of the needle (15) that was piercing through, in the shape of one or more holes, which of course renders the container subject to leakage. This phenomenon is usually called setting-up and appears within a few weeks after the needle (15) has been inserted. Surprisingly, it has been found that a pierceable membrane (14) as described hereafter provides excellent leak-tightness once it is pierced by the needles (15) of the appliance. Moreover, it shows the very good advantage that, once the reservoir (10) is removed from said appliance, said membrane (14) recloses in such a way that setting-up, and thus leakage is prevented, even after the reservoir (10) has been in place within the appliance for one month or more. Such a membrane is preferred in the context of a fitment according to the present invention.

This is achieved by making a membrane (14) which does not take a set after having been pierced. It has been found that this effect can be achieved by making the membrane (14) out of at least one layer of one or more material(s), including at least one layer of an elastomeric material. Preferably, the membrane (14) is made out of at least one layer elastomeric material that will provide good reclosability properties, that is to say, whenever the membrane (14) is pierced and even though the piercing means (15) stays into the membrane (14) over a long period of time, the elastomeric layer will prevent the membrane (14) from taking a set, and it will ensure that once the piercing means (15)—for example the needle (15)—is removed from the membrane (14), said membrane (14) will retrieve its initial—closed—shape, so as to prevent leakage. Additional layers made out of different materials may be used, for example one layer of a material that is chemically resistant to the reservoir (10) contents may constitute the inner layer of the membrane (14). Alternatively, materials such as metal, plastic, aluminum, alloys, paper or cardboard, Teflon, or any other suitable material may be added to the layer of elastomeric material, in any combination of layers.

In a first and preferred embodiment, the membrane (14) is made out of one layer of silicon, which provides excellent material memory, as well as good chemical resistance to the reservoir's contents.

In a second embodiment, the membrane (14) is made out of a combination of silicon and an inert PET. Silicon provides excellent memory to the materials, so that the membrane (14) will close back after having been pierced, whereas inert PET provides chemical resistance to the product contained inside the reservoir (10). In a most preferred embodiment of the present invention, the elastomeric membrane (14) is made out of two layers: one inner layer out of inert PET, which comes in contact to the inside of the reservoir (10) and is especially meant to chemically resist to its contents, and an outer layer which is on contact with the atmosphere, and is made out of a silicon.

In both of the preceding embodiments, the thickness of the membrane (14) is an important parameter, and has an influence on the memory of the material. Preferably, the membrane (14) has a thickness less than 1 cm, more preferably, less then 6 mm, and even more preferably less than 4 mm, all thicknesses being measured in the portion of the membrane (14) which is comprised in the middle portion of said membrane (14), i.e. in the region which will be pierced (see FIG. 2).

The membrane (14) can have any suitable shape, but preferably it has a circular shape, with an overall diameter preferably comprised within the range of 0.5 to 5 cm, more preferably comprised within the range of 0.7 to 2 cm, and even more preferably comprised within the range of 0.9 to 1.1 cm. It has been shown that a ratio of 3.6 mm thickness in the middle pierceable portion, for 1 cm overall diameter, provides good memory properties for a one layer silicon membrane (14), and prevents setting-up in a very good manner.

As previously described, the pierceable membrane (14) may be part of the appliance, but preferably, it is part of the reservoir (10) or the cap (28) closing said reservoir (10), and in the most preferred embodiment of the present invention, said pierceable membrane (14) is attached to the top portion of the cap (28). It must be attached in such a way that it is very difficult to remove it without using a tool. It can be mechanically inserted by means of ribs that fit into grooves, as shown in FIG. 2, or it can be attached by some other means, such as for example heat sealing, gluing, welding. It can also be co-injected in the same injection mold, together with the cap itself which provides the advantage of being cheap to produce. In case it is made out of silicon or similar elastomeric material, the membrane (14) can also be cast-molded, and then UV-cured.

The cap can have any suitable shape, for example it can have a truncated profile, as shown in FIG. 2. It can be screwed onto the neck (19) of the reservoir (10), for example by means of one or several screw threads, but it can also be secured by any other suitable means, such as bayonet fitment means, clipping means, or similar. However, a device (1) using a fitment according to the present invention is even better achieved if the reservoir (10) is equipped with a pierceable cap with silicon membrane (14), as previously described, wherein said cap can be secured onto the neck (19) of said reservoir (10), but cannot be removed. In such an embodiment, the reservoir (10) is difficult to open by children, because if the adult user needs to remove the reservoir (10) from the appliance when said reservoir (10) is not yet empty, the product contained inside said reservoir (10) cannot leak because the pierceable membrane (14)

recloses upon removal of the reservoir (10), and the cap cannot even be removed without using a tool and using a substantial amount of lever force. This means that there is low chance for a kid to get in contact with the composition contained inside. Such non-removable fitment can be achieved by any suitable means, such as for example screw threads with non return triangular lugs, which allow screwing of the cap, but whereby unscrewing is prevented.

What is claimed is:

1. A fitment for establishing a fluid communication between a dispensing appliance and a liquid reservoir comprising:

at least one pierceable means and at least one needle for piercing said at least pierceable means; and a movable protecting means for preventing access to said at least one needle when said reservoir is not connected to said appliance, wherein said protecting means covers said at least one needle when said needle is not in use, said movable protecting means is movable under manual force applied directly or undirectly thereto and wherein said protecting means comprises a spring loaded movable protecting plate that prevents access to said at least one needle when said reservoir is not connected to said appliance, said protecting plate moving upon insertion of said reservoir into said appliance in order to allow said at least one needle to pierce said pierceable means, thus establishing a fluid communication between said appliance and said reservoir.

2. A device comprising:

a dispensing appliance;

a liquid reservoir;

a fitment for removably connecting said liquid reservoir and said appliance, wherein said fitment includes at least one pierceable means, at least one needle for piercing said at least pierceable means and a movable protecting means for preventing access to said at least one needle when said reservoir is not connected to said appliance, wherein said protecting means covers said at least one needle when said needle is not in use, said movable protecting means is movable under manual force applied directly or undirectly thereto and wherein said protecting means comprises a spring loaded movable protecting plate that prevents access to said at least one needle when said reservoir is not connected to said appliance, said protecting plate moving upon insertion of said reservoir into said appliance in order to allow said at least one needle to pierce said pierceable means, thus establishing a fluid communication between said appliance and said reservoir.

3. The device according to claim 2, wherein said at least one needle and said protecting plate are located on said appliance, and said pierceable means is located on said reservoir.

4. The device according to claim 2, wherein said pierceable means is an elastomeric pierceable membrane.

5. A fitment for establishing a fluid communication between a dispensing appliance and a liquid reservoir comprising:

at least one pierceable means and at least one needle for piercing said at least pierceable means; and a movable protecting means for preventing access to said at least one needle when said reservoir is not connected to said appliance, wherein said protecting means covers said at least one needle when said needle is not in use, said movable protecting means is movable under manual force applied directly or undirectly thereto and wherein said movable protecting means comprises a movable protecting plate which has a recessed portion comprising a portion of said protecting plate that is disposed inward of the plane defined by the remainder of the protecting plate.

6. The fitment of claim 5 wherein said liquid reservoir has a cap thereon, and said recessed portion of said protecting plate is configured in a shape suitable for receiving said cap.

7. A fitment for establishing a fluid communication between a dispensing appliance and a liquid reservoir comprising:

at least one pierceable means and at least one needle for piercing said at least pierceable means; and a movable protecting means for preventing access to said at least one needle when said reservoir is not connected to said appliance, wherein said protecting means covers said at least one needle when said needle is not in use, said movable protecting means is movable under manual force applied directly or undirectly thereto and wherein said liquid reservoir comprises a bottle, and said bottle has at least one recess therein, and said dispensing appliance comprises at least one protrusion, wherein said at least one protrusion on said appliance fits into said at least one recess in said bottle.

8. The fitment of claim 1 wherein said movable protecting plate has a recessed portion comprising a portion of said protecting plate that is disposed inward of the plane defined by the remainder of the protecting plate.

9. The fitment of claim 8 wherein said liquid reservoir comprises a bottle, and said bottle has at least one recess therein, and said dispensing appliance comprises at least one protrusion, wherein said at least one protrusion on said appliance fits into said at least one recess in said bottle.

10. The fitment of claim 1 wherein said liquid reservoir comprises a bottle, and said bottle has at least one recess therein, and said dispensing appliance comprises at least one protrusion, wherein said at least one protrusion on said appliance fits into said at least one recess in said bottle.

11. The fitment of claim 5 wherein said liquid reservoir comprises a bottle, and said bottle has at least one recess therein, and said dispensing appliance comprises at least one protrusion, wherein said at least one protrusion on said appliance fits into said at least one recess in said bottle.

* * * * *